US010687558B2

(12) United States Patent
Qiu

(10) Patent No.: US 10,687,558 B2
(45) Date of Patent: Jun. 23, 2020

(54) ELECTRONIC CIGARETTE

(71) Applicant: Changzhou Patent Electronic Technology Co., LTD., Changzhou, Jiangsu Province (CN)

(72) Inventor: Weihua Qiu, Changzhou (CN)

(73) Assignee: CHANGZHOU PATENT ELECTRONIC TECHNOLOGY CO., LTD., Changzhou, Jiangsu Province (CN)

( * ) Notice: Subject to any disclaimer, the term of this patent is extended or adjusted under 35 U.S.C. 154(b) by 0 days.

(21) Appl. No.: 16/470,550

(22) PCT Filed: Dec. 7, 2017

(86) PCT No.: PCT/CN2017/115023
§ 371 (c)(1),
(2) Date: Jun. 17, 2019

(87) PCT Pub. No.: WO2018/108021
PCT Pub. Date: Jun. 21, 2018

(65) Prior Publication Data

US 2019/0328045 A1 Oct. 31, 2019

(30) Foreign Application Priority Data

Dec. 16, 2016 (CN) ..... 2016 2 1389600 U

(51) Int. Cl.

| | |
|---|---|
| ***A24F 47/00*** | (2020.01) |
| ***H01R 13/24*** | (2006.01) |
| ***H01R 13/627*** | (2006.01) |
| ***H01R 13/631*** | (2006.01) |

(52) U.S. Cl.
CPC ..... *A24F 47/008* (2013.01); *H01R 13/2478* (2013.01); *H01R 13/6276* (2013.01); *H01R 13/631* (2013.01)

(58) Field of Classification Search
CPC ..... A24F 47/008
See application file for complete search history.

(56) References Cited

U.S. PATENT DOCUMENTS 5,002,230 A * 3/1991 Norskov ..... B05B 1/3006 137/513.5
D788,362 S * 5/2017 Qiu ..... D27/101
2015/0296889 A1* 10/2015 Liu ..... A24F 47/008 131/329

(Continued)

FOREIGN PATENT DOCUMENTS

CN 104333624 A 2/2015
CN 104333625 A 2/2015

(Continued)

*Primary Examiner* — James Harvey
(74) *Attorney, Agent, or Firm* — Cheng-Ju Chiang

(57) ABSTRACT

An electronic cigarette includes a battery module and an atomizing module. The battery module is provided with a battery joint surface. The atomizing module is provided with an atomizing joint surface. The atomizing joint surface is provided with a guide rib, and the battery joint surface is provided with a guide groove, or the atomizing joint surface is provided with a guide groove, and the battery joint surface is provided with a guide rib. The guide rib is fitted in the guide groove so that the battery module and the atomizing module are assembled together.

15 Claims, 5 Drawing Sheets

(56) References Cited

U.S. PATENT DOCUMENTS

| | | | | |
|---|---|---|---|---|
| 2018/0166841 | A1* | 6/2018 | Chen | H01R 33/955 |
| 2018/0368476 | A1* | 12/2018 | Chen | A24F 47/008 |
| 2019/0276204 | A1* | 9/2019 | McKeon | A61M 15/0025 |
| 2019/0281896 | A1* | 9/2019 | Chapman | D04C 1/06 |
| 2019/0307174 | A1* | 10/2019 | Qiu | A24F 47/008 |
| 2019/0328045 | A1* | 10/2019 | Qiu | H01R 13/631 |

FOREIGN PATENT DOCUMENTS

| | | | |
|---|---|---|---|
| CN | 204169057 | U | 2/2015 |
| CN | 104770888 | A | 7/2015 |
| CN | 205567818 | U | 9/2016 |
| CN | 206354443 | U | 7/2017 |
| WO | 2015/190810 | A1 | 12/2015 |
| WO | 2016/197658 | A1 | 12/2016 |

* cited by examiner

ELECTRONIC CIGARETTE

CROSS REFERENCE TO RELATED APPLICATION

This application is a 35 U.S.C. § 371 National Phase conversion of International (PCT) Patent Application No. PCT/CN2017/115023, filed on Dec. 7, 2017, which claims the priority of Chinese Patent Application No. 201621389600.2, filed on Dec. 16, 2016. The contents of the above-identified applications are incorporated herein by reference. The PCT International Patent Application was filed and published in Chinese.

TECHNICAL FIELD

The present disclosure relates to the technical field of electronic cigarettes, and in particular, to an electronic cigarette.

BACKGROUND

Electronic cigarette is an electronic product that simulates tobacco cigarettes. It heats the cigarette liquid in the cartridge through the atomizing head, and atomizes the cigarette liquid to generate smoke. The smoke can be inhaled from the cigarette holder by the user, thereby achieving the purpose of simulating smoking.

At present, the atomizer and the battery module of the electronic cigarette adopt a threaded screw-type structure, assembling and disassembling are time-consuming and laborious; if the thread is not tightened, the atomizer may not work normally; if the thread is too tight, it may be more laborious when disassembling, to affect the user experience.

SUMMARY

An object of the present disclosure is to solve the problems in the prior art, and to provide an electronic cigarette with convenient disassembling and assembling.

The technical solution adopted by the present disclosure is as follows:

An electronic cigarette includes a battery module and an atomizing module. The battery module is provided with a battery joint surface. The atomizing module is provided with an atomizing joint surface. The atomizing joint surface is provided with a guide rib, and the battery joint surface is provided with a guide groove, or the atomizing joint surface is provided with a guide groove, and the battery joint surface is provided with a guide rib. The guide rib is fitted in the guide groove so that the battery module and the atomizing module are assembled together.

Further, the battery joint surface and the atomizing joint surface are fixedly connected by a locking mechanism. When the guide rib is fitted into the guide groove and assembled in position, the locking mechanism locks the guide rib in the guide groove.

Further, the locking mechanism includes an indentation disposed on the surface of the guide rib, a ball disposed in the guide groove, and a first elastic member for driving the ball up and down.

Further, the atomizing joint surface is set as a first polarity contact surface of the atomizing module. The battery joint surface is provided with a first polarity contact member and a second elastic member for driving the first polarity contact member up and down. When the guide rib is fitted in the guide groove and assembled in position, the first polarity contact member abuts against the first polarity contact surface to realize electrical connection between the battery module and a first polarity of the atomizing module.

Further, the atomizing joint surface is provided with a second polar member insulated from the first polarity contact surface, and the battery joint surface is provided with a second polarity contact member and a third elastic member for driving the second polarity contact member up and down. When the guide rib is fitted in the guide groove and assembled in position, the second polarity contact member abuts against the second polar member to realize electrical connection between the battery module and a second polarity of the atomizing module.

Further, the ball, the first polarity contact member and the second polarity contact member are arranged on the same straight line.

Further, the first elastic member, the second elastic member and the third elastic member are springs.

Further, the guide rib is provided with transitional slopes at two opposite ends thereof.

Further, the atomizing module includes a main body and an atomizer disposed in the main body. The atomizer is provided with a second polar contact at one end thereof near the atomizing joint surface. The second polar member is disposed in an insulation member. The second polar member and the insulating member are pressed into the main body from the atomizing joint surface to electrically connect the second polar member with the second polar contact.

Further, a mouthpiece is further included, and the mouthpiece is disposed at an upper end of the atomizing module.

The beneficial effects of the present disclosure are:

The guide rib and the guide groove are separately provided on the battery module and the atomizing module, such that the battery module and the atomizing module are assembled together through the cooperation of the guide rib and the guide groove. Such is a detachable connection method, so that the electronic cigarette applying the connection method has the characteristics of convenient disassembling and assembling.

BRIEF DESCRIPTION OF THE DRAWINGS

The drawings are intended to provide a further understanding of the present disclosure and be a part of the description of the present disclosure. They are used to explain the present disclosure together with the following specific embodiments, but should not constitute a limitation on the present disclosure. In the drawings.

Figure 1:
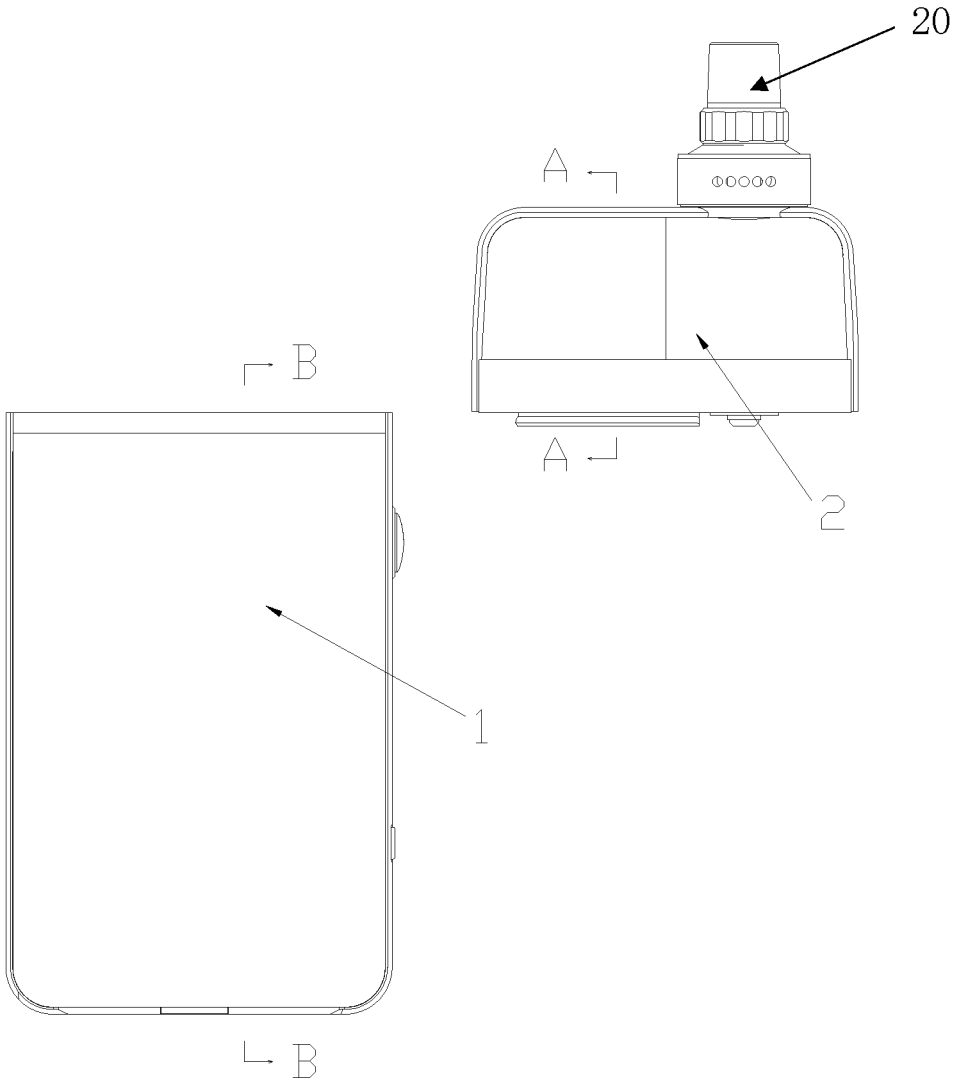
FIG. 1 is a front elevational view showing the atomizing module and the battery module in an exploded state in the embodiment of the present disclosure.
Figure 2:
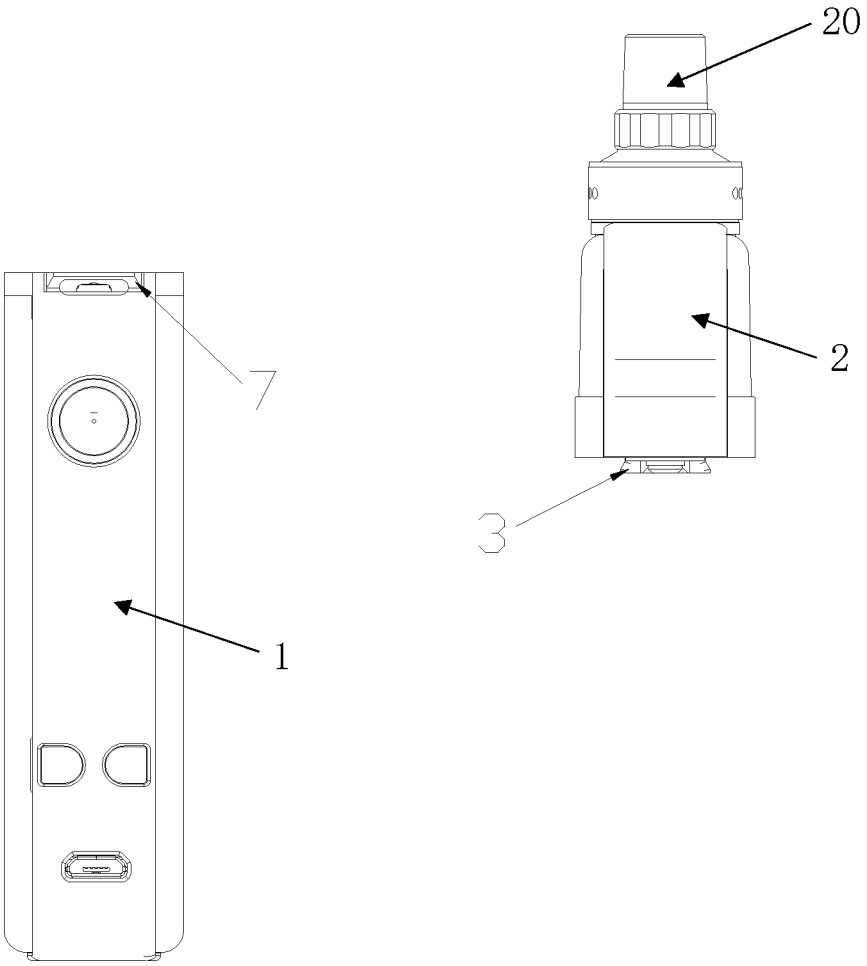
FIG. 2 is a left side view of the atomizing module and the battery module in the embodiment of the present disclosure.

The part names and their reference signs in the drawings are:

| | |
|---|---|
| battery module 1 | atomizing module 2 |
| guide rib 3 | indentation 4 |
| transition slope 5 | second polar member 6 |
| guide groove 7 | ball 8 |
| first elastic member 9 | first polarity contact member 10 |
| second polarity contact member 11 | battery joint surface 12 |
| atomizer 15 | mouthpiece 20 |
| atomizing joint surface 21 | insulating member 61 |
| second polar contact 151 | guide opening 71 |
| blind hole 81 | second elastic member 13 |
| third elastic member 14 | locking mechanism 489 |
| blocking portion 811 | |

DETAILED DESCRIPTION OF PREFERRED EMBODIMENTS

The specific embodiments of the present disclosure will be described in detail below with reference to the accompanying drawings. It is understood that the specific embodiments described herein are illustrative of the present disclosure and are not intended to limit the present disclosure.

Referring to FIGS. 1-2 and FIGS. 5-6, the present embodiment discloses an electronic cigarette, including a battery module 1 and an atomizing module 2 detachably connected to the battery module 1. The battery module 1 is provided with a battery joint surface 12. The atomizing module 2 is provided with an atomizing joint surface 21. The atomizing joint surface 21 is provided with a guide rib 3, and the battery joint surface 12 is provided with a guide groove 7; or optionally, the atomizing joint surface 21 is provided with a guide groove 7, and the battery joint surface 12 is provided with a guide rib 3. The guide rib 3 is embedded in the guide groove 7 to assemble the battery module 1 and the atomizing module 2 together.

In the present embodiment, the guide groove 7 is provided with an inlet (not shown) for entering of the guide rib 3, and the inlet is located at a side surface of the battery module 1 or the atomizing module 2. The guide rib 3 can be pushed into the guide groove 7 in a direction parallel or non-parallel to the battery joint surface 12.

When assembling, the battery joint surface 12 of the battery module 1 faces the atomizing joint surface 21 of the atomizing module 2, the front end of the guide rib 3 is aligned with the inlet of the guide groove 7, and the guide rib 3 is pushed into the guide groove 7 along the direction of the guide groove 7, such that the installation is completed. When disassembling, the guide rib 3 is pushed out of the guide groove 7 in the direction opposite to assembling. In order to push the guide rib 3 into the guide groove 7 more easily, a guide opening 71 larger than the width of the guide rib 3 is provided at the inlet of the guide groove 7.

Figure 3:
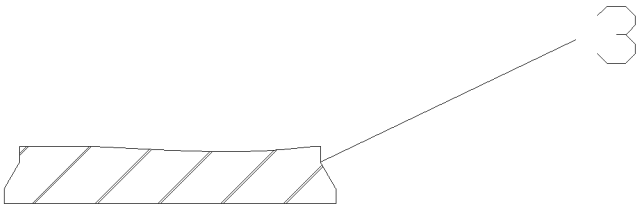
FIG. 3 is a cross-sectional view of the guide rib along the line A-A in the embodiment of the present disclosure.
Figure 4:
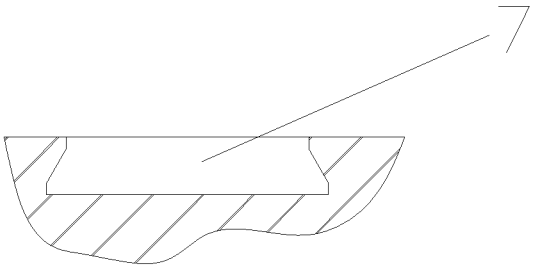
FIG. 4 is a cross-sectional view of the guide groove along the line B-B in the embodiment of the present disclosure.

In the present embodiment, as shown in FIGS. 3-4, the cross section of the guide rib 3 along line A-A has an inverted T shape. Correspondingly, the cross section of the guide groove 7 along line B-B has an inverted T shape. When the guide rib 3 is fitted into the guide groove 7, it is fitted by the matching structure between them. In other embodiments, the shape of the guide groove 7 is adapted to the shape of the guide rib 3, and the specific shape of the guide groove 7 and the guide rib 3 is not limited, as long as it is ensured that the guide rib 3 can move in the guide groove 7 along the direction of the guide groove 7 and cannot move in other directions.

Therefore, in the electronic cigarette, the guide rib 3 and the guide groove 7 are separately provided on the battery module 1 and the atomizing module 2, such that the battery module 1 and the atomizing module 2 are assembled together through the cooperation of the guide rib 3 and the guide groove 7. Such is a detachable connection method, so the electronic cigarette applying the connection method has the characteristics of convenient disassembling and assembling, and is a plug-in type electronic cigarette.

Figure 5:
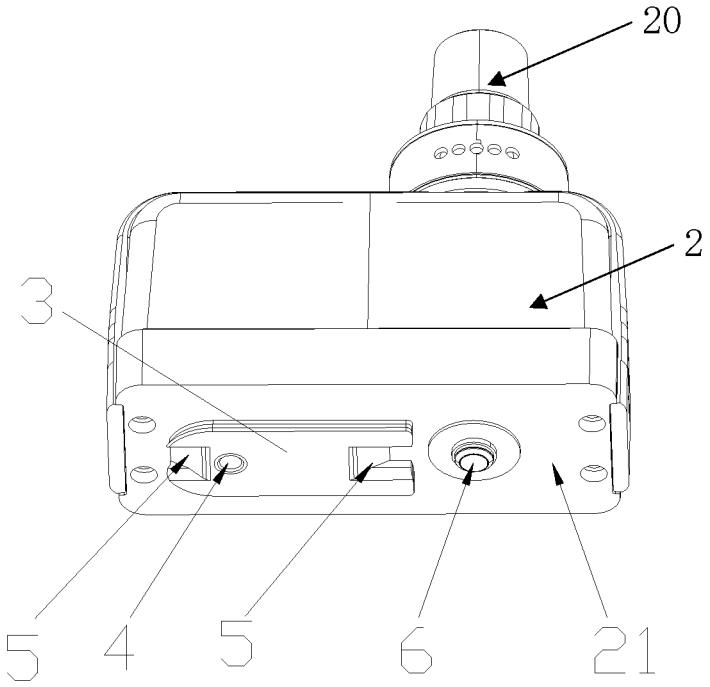
FIG. 5 is a perspective view of the atomizing module in the embodiment of the present disclosure.
Figure 6:
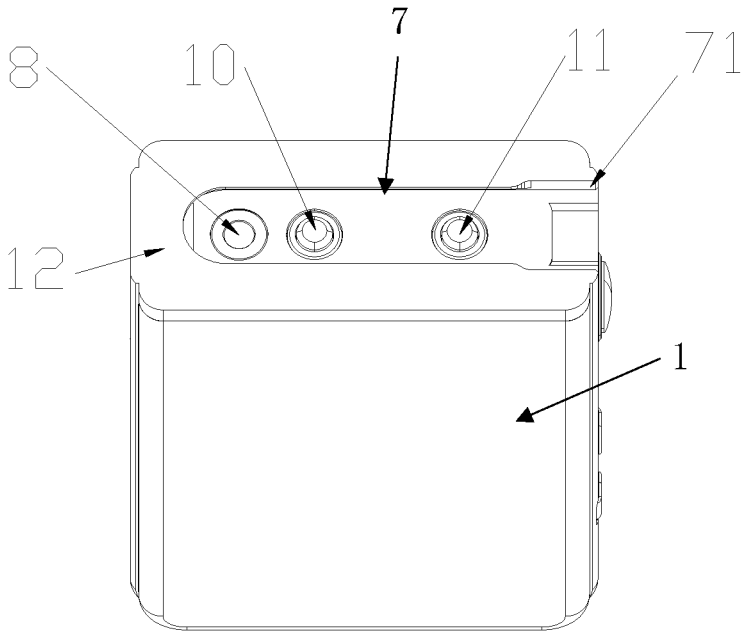
FIG. 6 is a perspective view of the battery module in the embodiment of the present disclosure.
Figure 7:
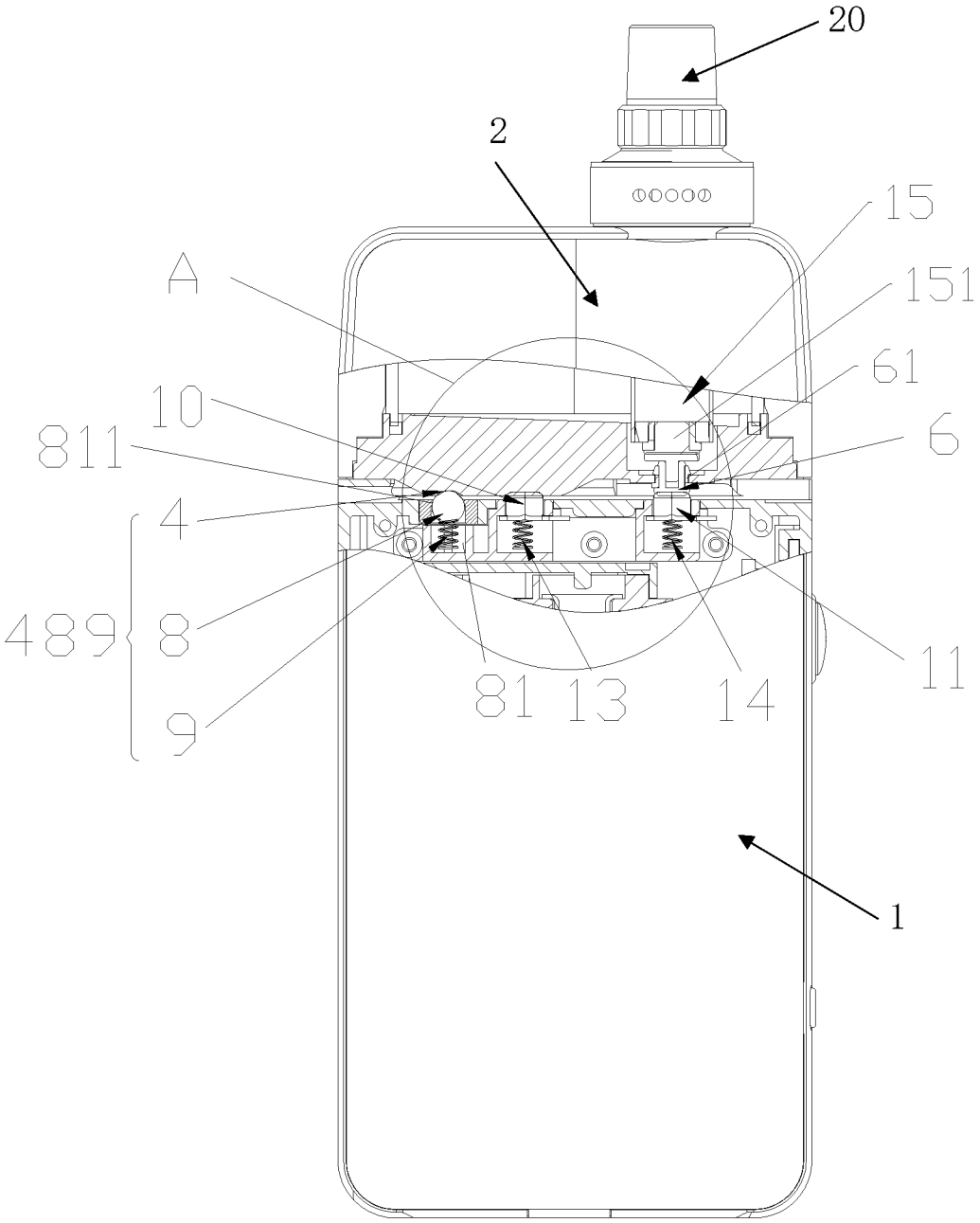
FIG. 7 is a partially cross-sectional view of the electronic cigarette in the embodiment of the present disclosure.

Referring to FIGS. 5-7, the battery joint surface 12 and the atomizing joint surface 21 are fixedly connected by a locking mechanism 489. The locking mechanism 489 includes an indentation 4 disposed on the surface of the guide rib 3, a ball 8 disposed in the guide groove 7, and a first elastic member 9 used for driving the ball 8 up and down. When the guide rib 3 is fitted into the guide groove 7 and assembled in position, the locking mechanism 489 locks the guide rib 3 in the guide groove 7. Specifically, the surface of the guide rib 3 is provided with an indentation 4, and the guide groove 7 is provided with a ball 8 and a first elastic member 9 for driving the ball 8 up and down. When the guide rib 3 is fitted into the guide groove 7 and assembled in position, the ball 8 is partially embedded in the indentation 4, thereby restricting the guide rib 3 from being disengaged from the guide groove 7. The engagement of the ball 8 in the indentation 4 serves to limit the sliding movement between the guide rib 3 and the guide groove 7, and functions as a lock when the guide rib 3 and the guide groove 7 are assembled in position. In the present embodiment, the ball 8 is a steel ball. It is to be understood that in other embodiments not shown, the ball 8 may also be made of other hard materials such as copper, iron, and the like.

Figure 8:
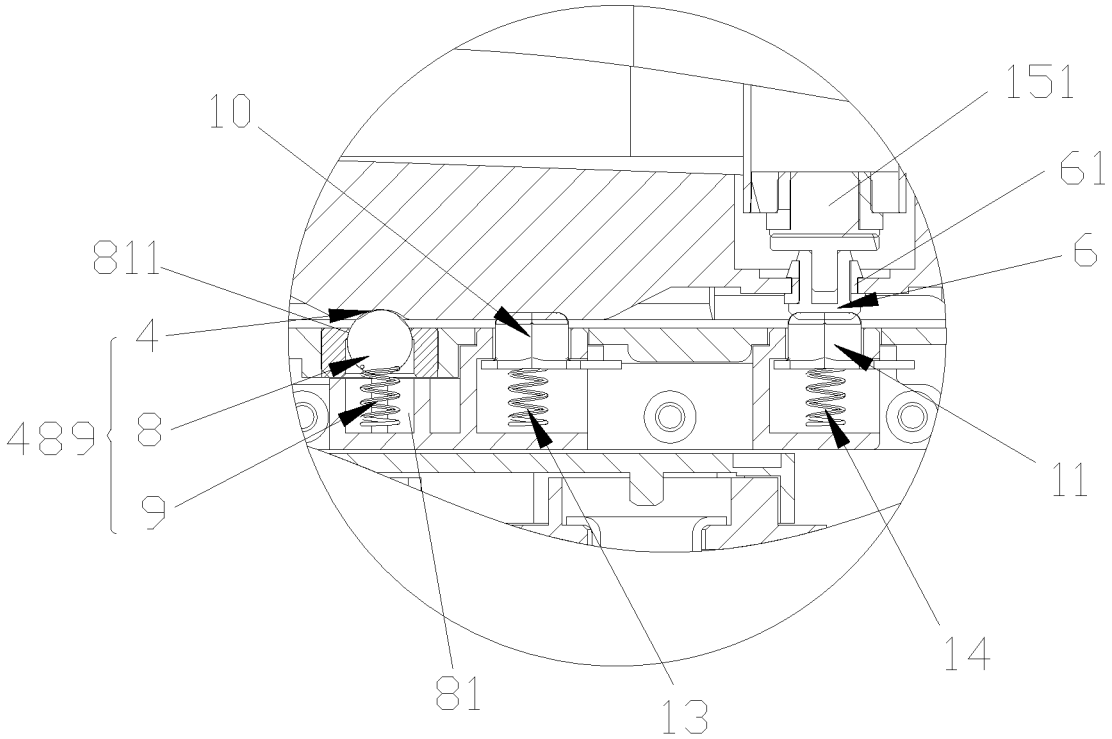
FIG. 8 is an enlarged view of the portion A of FIG. 7 in the embodiment of the present disclosure.

Specifically, as shown in FIGS. 7 and 8, the guide groove 7 is provided with a blind hole 81 having a diameter larger than or equal to the diameter of the ball 8. The ball 8 is disposed in the blind hole 81. A blocking portion 811 is provided at the opening of the blind hole 81. The blocking portion 811 may be a flange formed integrally with the side wall of the blind hole 81 and extending towards the center of the blind hole 81, or be an annular member independent of the side wall of the blind hole 81 disposed inside the opening of the blind hole 81. Due to the blocking portion 811, a diameter at the opening of the blind hole 81 is smaller than the diameter of the ball 8, so that the ball 8 can be exposed from the opening without completely sliding out from the opening of the blind hole 81. The first elastic member 9 is disposed in the blind hole 81 between the bottom of the ball 8 and the bottom of the blind hole 81. The first elastic member 9 is in a certain compression state, so that the ball 8 is kept at the opening at all times. When the guide rib 3 is pushed into the guide groove 7, the surface of the guide rib 3 presses the ball 8 downward into the blind hole 81 until the position of the indentation 4 is aligned with the position of the blind hole 81, the ball 8 is bounced and pushed into the indentation 4, and then the guide rib 3 cannot be pushed further. When assembled in position, the ball 8 is pushed into the indentation 4, and a clattering sound is emitted to imply that the assembly is in place. In the present embodiment, the first elastic member is a spring. It is to be understood that, in other embodiments not shown, the first elastic member may also be an element having elasticity and rigidity such as a stainless steel sheet or the like, or may be made of flexible, soft materials such as rubber, silicone or the like.

The battery module 1 is used to supply power to the atomizing module 2. In the embodiment, the atomizing joint surface 21 is set as a first polarity contact surface of the atomizing module 2, and the battery joint surface 12 is provided with a first polarity contact member 10 and a second elastic member 13 for driving the first polarity contact member 10 up and down. When the guide rib 3 is fitted in the guide groove 7 and assembled in position, the first polarity contact member 10 abuts against the first polarity contact surface to realize electrical connection between the battery module 1 and a first polarity of the atomizing module 2. More specifically, since the guide rib 3 and the guide groove 7 are interchangeable on the battery module 1 and the atomizing module 2, when the guide rib 3 is provided on the atomizing module 2, the first polarity contact member 10 abuts against the surface of the guide rib 3; when the guide groove 7 is provided on the atomizing module 2, the first polarity contact member 10 abuts against the surface of the guide groove 7. The atomizing joint surface 21 is provided with a second polar member 6 insulated from the first polarity contact surface, and the battery joint surface 12 is provided with a second polarity contact member 11 and a third elastic member 14 for driving the second polarity contact member 11 up and down. When the guide rib 3 is fitted into the guide groove 7 and assembled in position, the second polarity contact member 11 abuts against the second polar member 6 to realize electrical connection between the battery module 1 and a second polarity of the atomizing module 2. Similarly, the second elastic member 13 and the third elastic member 14 are springs. It is to be understood that in other embodiments not shown, the second elastic member 13 and the third elastic member 14 may also be an element having elasticity and rigidity such as a stainless steel sheet or the like. In the embodiment, the first polarity is a negative polarity and the second polarity is a positive polarity. In other embodiments, the first polarity is a positive polarity and the second polarity is a negative polarity. It is to be understood that the second elastic member 13 may further be electrically connected to electric components in the battery module 1 to achieve electric conduction, and the electric components include, but are not limited to, a battery and a circuit board.

It is to be understood that the first polarity contact member 10, the second polarity contact member 11 and the second polar member 6 may be needle-shaped, sheet-like, block-shaped or columnar conductors, and optionally may be made of metals such as copper or aluminum.

In order to push the ball 8 into the blind hole 81 more easily when the guide rib 3 is pushed into the guide groove 7, opposite ends of the guide rib 3 are each provided with a transition slope 5. In the present embodiment, the ball 8, the first polarity contact member 10 and the second polarity contact member 11 are arranged on the same straight line. The ball 8, the first polarity contact member 10 and the second polarity contact member 11 slide over the same path through the guide rib 3 from the transition slope 5.

The atomizing module 2 includes a main body (not shown) and an atomizer 15 disposed in the main body. The atomizer 15 is provided with a second polar contact 151 at one end thereof near the atomizing joint surface 21. The atomizing module 2 further includes an insulating member 61, and the insulating member 61 is interposed between the second polar member 6 and the atomizing joint surface 21. The second polar member 6 and the insulating member 61 are pressed into the main body from the atomizing joint surface 21 to electrically connect the second polar member 6 with the second polar contact 151.

The electronic cigarette of the embodiment further includes a mouthpiece 20, the mouthpiece 20 is disposed at an upper end of the atomizing module 2.

Any combination of different embodiments of the present disclosure should be considered as disclosed by the present disclosure as long as it does not contradict the technical idea of the present disclosure. Within the scope of the technical idea of the present disclosure, simple variations to the technical solution and any combination of different embodiments that do not contradict the technical idea of the present disclosure should be within the scope of the present disclosure.

What is claimed is:

1. An electronic cigarette comprising a battery module and an atomizing module, the battery module and the atomizing module being arranged along a vertical direction with the atomizing module at a top side and the battery module at a bottom side along the vertical direction, wherein the battery module is provided with a battery joint surface, the atomizing module is provided with an atomizing joint surface, the battery joint surface and the atomizing joint surface are substantially flat surfaces extending along a horizontal direction perpendicular to the vertical direction; the atomizing joint surface is provided with a guide rib, and the battery joint surface is provided with a guide groove, or the atomizing joint surface is provided with a guide groove, and the battery joint surface is provided with a guide rib; both the guide rib and the guide groove extend along the horizontal direction, when the battery module and the atomizing module are caused to move relative to each other along the horizontal direction, the guide rib slides in the guide groove until the guide rib is fitted in the guide groove, so that the battery module and the atomizing module are assembled together.

2. The electronic cigarette according to claim 1, wherein the battery joint surface and the atomizing joint surface are fixedly connected by a locking mechanism, when the guide rib is fitted into the guide groove and assembled in position, the locking mechanism locks the guide rib in the guide groove.

3. The electronic cigarette according to claim 2, wherein the locking mechanism comprises an indentation disposed on the surface of the guide rib, a ball disposed in the guide groove, and a first elastic member for driving the ball up and down, when the guide rib is fitted into the guide groove and assembled in position, the ball is partially embedded in the indentation.

4. The electronic cigarette according to claim 3, wherein the atomizing joint surface is set as a first polarity contact surface of the atomizing module, the battery joint surface is provided with a first polarity contact member and a second elastic member for driving the first polarity contact member up and down, when the guide rib is fitted in the guide groove and assembled in position, the first polarity contact member abuts against the first polarity contact surface to realize electrical connection between the battery module and a first polarity of the atomizing module.

5. The electronic cigarette according to claim 4, wherein the atomizing joint surface is provided with a second polar member insulated from the first polarity contact surface, and the battery joint surface is provided with a second polarity contact member and a third elastic member for driving the second polarity contact member up and down, when the guide rib is fitted in the guide groove and assembled in position, the second polarity contact member abuts against the second polar member to realize electrical connection between the battery module and a second polarity of the atomizing module.

6. The electronic cigarette according to claim 5, wherein the ball, the first polarity contact member and the second polarity contact member are arranged on the same straight line.

7. The electronic cigarette according to claim 5, wherein the first elastic member, the second elastic member and the third elastic member are springs.

8. The electronic cigarette according to claim 1, wherein the guide rib is provided with transitional slopes at two opposite front and rear ends thereof.

9. The electronic cigarette according to claim 5, wherein the atomizing module comprises a main body and an atomizer, the atomizer is disposed in the main body, the atomizer is provided with a second polar contact at one end thereof near the atomizing joint surface, the second polar member is disposed in an insulation member, the second polar member and the insulating member are pressed into the main body from the atomizing joint surface to electrically connect the second polar member with the second polar contact.

10. The electronic cigarette according to claim 8, further comprising a mouthpiece, wherein the mouthpiece is disposed at an upper end of the atomizing module.

11. The electronic cigarette according to claim 1, wherein the guide rib is pushed into the guide groove along the direction of the guide groove when the battery module and the atomizing module are assembled, the guide rib is pushed out of the guide groove in a direction opposite to assembling when the battery module and the atomizing module are disassembled.

12. The electronic cigarette according to claim 1, wherein the guide groove is provided with an inlet located at a side surface of the battery module or the atomizing module, and the guide rib is pushed into the guide groove from the inlet.

13. The electronic cigarette according to claim 12, wherein a guide opening larger than a width of the guide rib is provided at the inlet of the guide groove.

14. The electronic cigarette according to claim 3, wherein the guide groove is provided with a blind hole having a diameter larger than or equal to the diameter of the ball, the ball is disposed in the blind hole, the first elastic member is disposed in the blind hole between the bottom of the ball and the bottom of the blind hole, the first elastic member is in a compression state, a blocking portion is provided at the opening of the blind hole, and a diameter at the opening of the blind hole is smaller than the diameter of the ball due to the blocking portion.

15. The electronic cigarette according to claim 1, wherein the atomizing joint surface is provided with the guide rib, and the battery joint surface is provided with the guide groove, the guide rib protrudes out from the atomizing joint surface downwardly towards the battery module, the guide groove is recessed inwardly and downwardly from the battery joint surface to be located below the battery joint surface.

* * * * *